US005483701A

United States Patent [19]

Ferreyros

[11] Patent Number: 5,483,701

[45] Date of Patent: Jan. 16, 1996

[54] COMBINED BIB AND STORAGE POUCH

[76] Inventor: Enrique Ferreyros, 913 Wildwood, Bellaire, Tex. 77401

[21] Appl. No.: 189,320

[22] Filed: Jan. 31, 1994

[51] Int. Cl.[6] ..... A41B 13/10

[52] U.S. Cl. ..... 2/49.2; 2/49.1; 2/247

[58] Field of Search ..... 2/46, 49.1, 49.2, 2/49.3, 49.4, 49.5, 50, 51, 52, 88, 89, 75, 80, 69, 69.5, 48, 247, 248, 249, 250, 251, 252; 224/151

[56] References Cited

U.S. PATENT DOCUMENTS

| | | | |
|---|---|---|---|
| 1,246,871 | 11/1917 | Cabelinsky | 2/88 |
| 1,548,830 | 8/1925 | Dunsworth . | |
| 2,389,596 | 11/1945 | Charnas et al. . | |
| 2,504,534 | 4/1950 | Kephart et al. . | |
| 3,085,254 | 4/1963 | Cutler . | |
| 3,522,612 | 8/1970 | Palmer | 2/88 |
| 3,670,340 | 6/1972 | Walker . | |
| 4,165,542 | 8/1979 | McLaughlin | 2/209.1 |
| 4,404,689 | 9/1983 | DeWan | 2/88 |
| 4,458,364 | 7/1984 | Fenninger et al. | 2/50 |
| 4,459,703 | 7/1984 | Kosmas et al. | 2/48 |
| 4,545,079 | 10/1985 | Bakken | 2/48 |
| 4,860,383 | 8/1989 | Warn | 2/88 |
| 4,884,298 | 12/1989 | Silas . | |
| 4,924,527 | 5/1990 | Hintermeyer . | |
| 4,924,528 | 5/1990 | Trombelti-Dickens | 2/46 |
| 5,010,592 | 4/1991 | Skiles, Jr. . | |
| 5,036,547 | 8/1991 | Silas . | |
| 5,046,980 | 9/1991 | Tai et al. . | |
| 5,052,052 | 10/1991 | Gilford et al. | 2/69 |
| 5,244,278 | 9/1993 | Robitaille | 2/49.2 |

FOREIGN PATENT DOCUMENTS

| | | | |
|---|---|---|---|
| 3343633 | 6/1985 | Germany | 2/50 |

*Primary Examiner*—Jeanette E. Chapman
*Attorney, Agent, or Firm*—Bush, Moseley, Riddle & Jackson

[57] ABSTRACT

A bib (10) for fitting about the neck of a baby and having a one piece body (12) and a pocket or pouch (14) secured thereto. Pouch (14) is secured to bib (10) between a pair of spaced neck portions (18) and (20) with the closed end of pouch (14) stitched to bib (10) along an upper edge of bib (10). The pouch (14) is free and turned outside in when the bib (10) is positioned about the neck of a child. The bib (10) is placed within pouch (14) by folding it or stuffing it via the closed end of the pouch while the pouch is turned inside out. The open end 35 of pouch (14) is then closed with bib (10) therein, and pouch (14) may then be stored or transported.

2 Claims, 2 Drawing Sheets

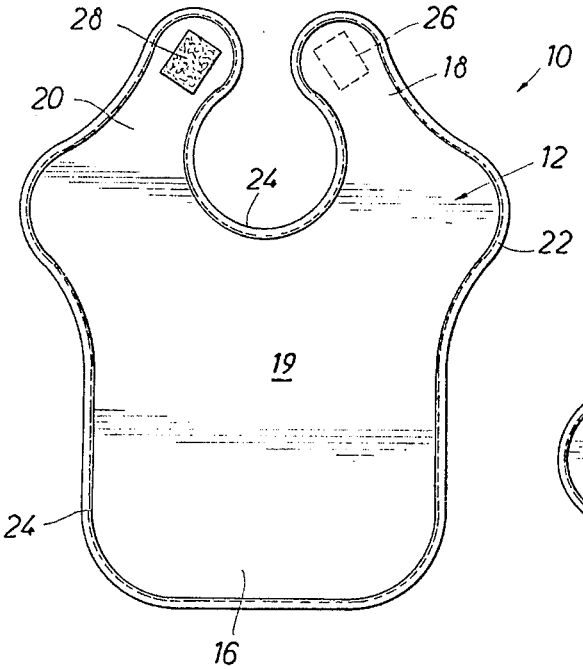
FIG. 1
FIG. 2
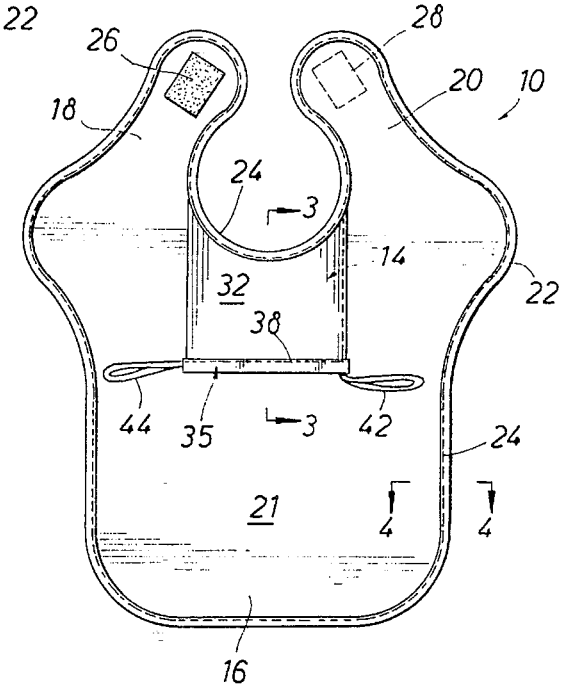
FIG. 3
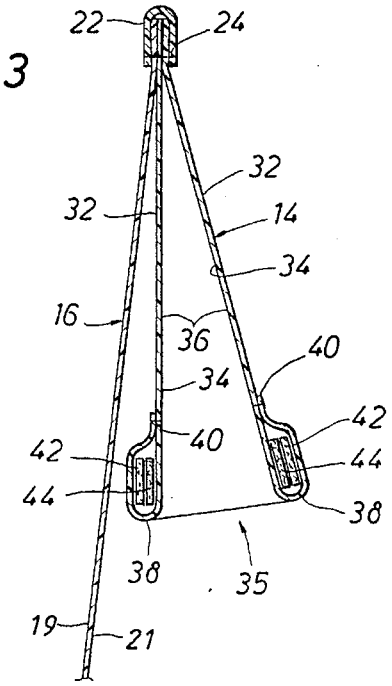
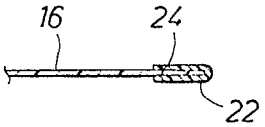
FIG. 4

FIG.5
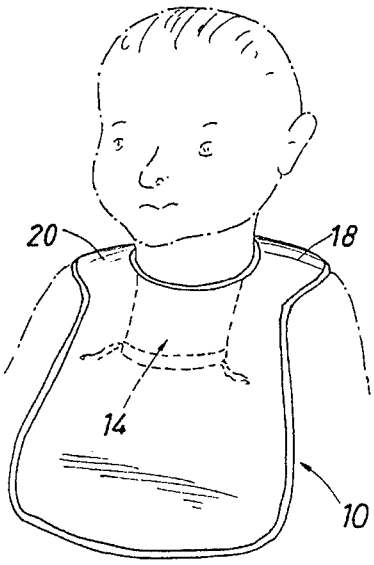
FIG.6
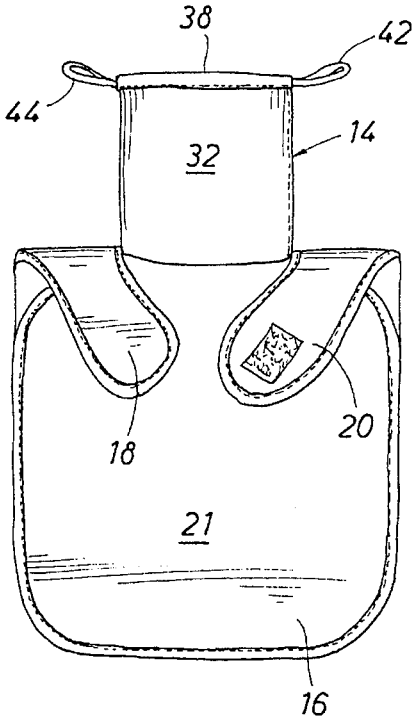
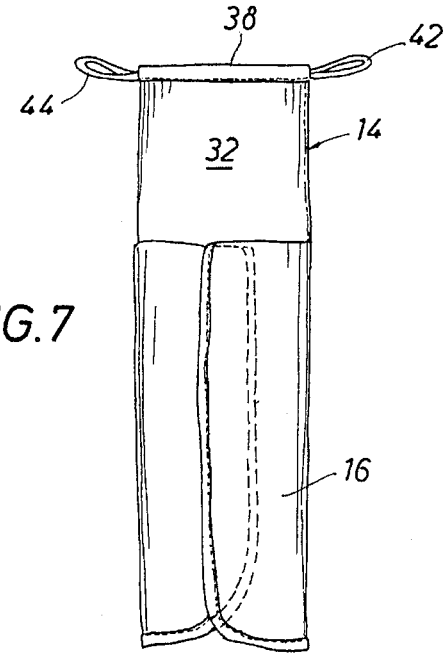
FIG.7
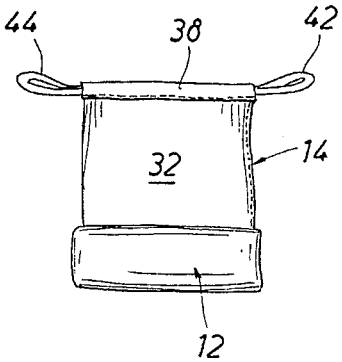
FIG.8
FIG.9
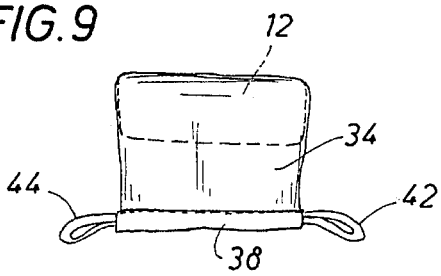
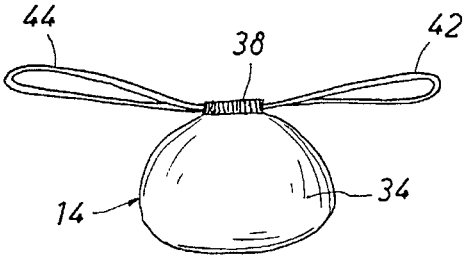
FIG.10

COMBINED BIB AND STORAGE POUCH

FIELD OF THE INVENTION

This invention relates to a combined bib and storage pouch for a child, and more particularly to such a combined bib and storage pouch in which the storage pouch is an integral portion of the bib.

BACKGROUND OF THE INVENTION

Heretofore, various garments have been provided with storage pockets in which the garments have been stored. The storage pockets have been provided at various locations on the garments. For example, U.S. Pat. No. 3,085,254 dated Apr. 16, 1963 shows a garment, such as a raincoat or beach robe, having a zippered side or pocket in which the garment is folded or stuffed after pulling the bottom of the pocket outwardly through the open top of pocket. Thus, the pocket is converted into a carrying bag for the garment.

U.S. Pat. No. 5,046,980 dated Sep. 10, 1991 shows a toy device including a bib which may be pulled outwardly from a compartment in the toy device for use by a child, and then the bib is rolled or folded back inside the compartment when the child has finished eating or drinking. The compartment is in the form of an animal and a carrying handle is attached to the compartment or container for carrying by the child.

Other United States Patents, such as U.S. Pat. No. 5,010,592 dated Apr. 30, 1991 and U.S. Pat. No. 4,404,689 dated Sep. 30, 1983, also show garments or articles having a pocket in which the garment may be folded or stuffed for transport. However, these pockets are positioned on the front of the garments with the opening to the pocket exposed to the front or outer surface of the garment.

SUMMARY OF THE PRESENT INVENTION

The present invention is directed to a bib for a child including a pocket or pouch on the rear side or surface of the bib for storage of the bib or transport. The pouch is not visible from the front of the bib when the bib is positioned about the neck of a child and is supported in a free relation on the rear of the bib from the closed end of the pouch. When the bib is in use on the child, the pouch is turned inside out and extends downward from its closed end with the opening for the pouch facing downwardly. Thus, if food or liquids drip or drop downwardly from the mouth of the child behind the bib, only the inside of the pouch will be contaminated as the pouch is turned inside out when used for storage of the bib.

The body of the bib includes a one-piece fabric material which includes a central front body portion for fitting against the outer front body of a child and a pair of spaced neck portions extending from the upper side of the front body portion. A generally U-shaped edging strip extends along the entire periphery of the one piece bib and is stitched to the one piece bib to form a continuous seam about the outer periphery of the body. An upper portion of the edging strip is arranged to fit against the neck of a child with the extending neck portions releasably secured at their ends behind the neck of the child for securement of the bib.

The pocket or pouch has a closed end and an open end with a releasable closure, such as Velcro type strips, for the open end. The closed end of the pouch with the pouch being turned inside out is sewn along the upper edge of the rear surface of the front body portion between the extending neck portions and extends downwardly in a free relation when the bib is placed on a child. For positioning of the bib within the pouch for storage and/or transport, the bib may be first folded into a compact size to fit within the pouch, and the pouch which is inside out, is then folded over the compact folded bib to reverse the inner and outer sides of the pouch so that the outer side of the pouch faces outwardly. The open side of the pouch is then closed with the bib being within the pouch for transport or storage within a handbag or the like. The bib including the pouch is formed of a waterproof material, such as waterproof nylon.

It is an object of this invention to provide a bib for children having a pouch on the bib to receive the bib for transport or storage in a handbag or the like.

It is a further object of this invention to provide such a bib in which the pouch is secured to the rear side of the bib in such a manner that food or liquids dropping from the mouth of the child will not contaminate or soil the outer side of the pouch when converted for storage of the bib.

Another object of the invention is to provide a pouch formed of a waterproof material so that storage of a soiled bib within the pouch will not contaminate or soil by leakage or permeation a container such as a handbag in which the stored bib is transported.

Other objects, features and advantages of the invention will be apparent from the following specifications and drawings.

BRIEF DESCRIPTION OF THE DRAWINGS

FIG. 1 is a front view of the bib of the present invention;

FIG. 2 is a rear view of the bib shown in FIG. 1;

FIG. 3 is a section taken generally along line 3—3 of FIG. 2;

FIG. 4 is a section taken generally along line 4—4 of FIG. 2;

FIG. 5 is a perspective of the bib of FIGS. 1–4 shown in position about the neck of a child; and FIG. 6–10 are views showing sequential steps in the folding of the bib shown in FIGS. 1–5 for placing within an integral pouch of the bib for storing or transport.

DESCRIPTION OF THE INVENTION

Referring particularly to FIGS. 1 and 2, an illustrative embodiment of the bib of the present invention is shown generally at 10 having a one-piece body shown at 12 and a pouch or pouch generally indicated at 14 secured thereto. Body 12 is formed of a one-piece material or fabric including a central body portion 16 and spaced neck portions 18, 20 extending upwardly from central body portion 16. Body 12 has a front surface or side 19 and an opposed rear surface or side 21. The edge or marginal edge portion extending about the periphery of one piece body 14 has a U-shaped fabric edging or edge strip 22 stitched thereto at 24 to form a seam about the entire outer periphery of body 14 as shown particularly in FIG. 4. Neck portions 18 and 20 have Velcro brand strips 26, 28 which include cooperating hook and loop portions for releasable securement to each other when pressed together. For securing bib 10 about the neck of a child as shown in FIG. 5, neck portions 18 and 20 are placed about the neck of a child, and strips 26, 28 are pressed against each other for securing the bib 10 about the neck of a child.

Pocket or pouch 14 forms an important part of this invention and is secured to the rear side 21 of body 12. The body of pouch 14 has an inner surface 32 and an outer surface 34. When bib 10 is being used as shown in FIG. 5, pouch 14 is turned inside out with inner surface 32 on the outside while outer surface 34 is on the inside of pouch 14. Pouch 14 has a closed end stitched at 24 to edge strip 22 and an opposed open end 35 formed between opposed sides 36 of pouch 14 as shown particularly in FIG. 3. Sides 36 have open ended loops 38 formed by stitching at seams 40. Loops 38 receive opposed drawstrings 42 and 44. Drawstrings 42 and 44 may be pulled for closing pouch 14 when bib 10 is stored therein as will be explained further. Since outer surface 34 of pouch 14 is on the inside of pouch 14 when bib 10 is in use, any food, liquid or other waste material which may be deposited on pouch 14 will be on the inner surface 32 of pouch 14. Thus the outer surface 34 on pouch 14 will be clean and not contaminated by bib 10 or any food or liquid which may drop behind bib 10 when bib 10 is positioned on a child. Pouch 14 has bib 10 compressed and stored therein as indicated below and in this position may be carried by a handbag or the like without any contamination of the handbag. The fabric or material from which bib 10 is formed is waterproof, such as waterproof nylon or polyester material. In lieu of loops 38 and drawstrings 42, 44 mating Velcro brand strips may be positioned on opposed relation on sides 36 for closing open end 35.

Referring to FIG. 6-10, steps are shown in sequence for folding bib 10 into a relatively small compressed mass, and then folding pouch 14 over the folded bib 10 for storage within pouch 14. First, pouch 14 is folded outwardly of body portion 16 as shown in FIG. 6 with neck portions 18 and 20 folded downward onto central body portion 16. Next, side portions of central body portion 16 along with neck portions 18 and 20 are folded over central body portion 16 as shown in FIG. 7. In this position, the bib is rolled or folded into a compact mass as shown at 12 in FIG. 8 positioned adjacent the closed end of pouch 14 which remains in the position shown in FIG. 6 with inner surface 32 on the outside. In this position, pouch 14 is then rolled over the compressed bib 10 to turn pouch 14 right side out with outer surface 34 on the outside while placing the open end 35 over the compressed body 12 of bib 10. After the compressed folded body 12 is positioned within pouch 14, drawstrings 42 and 44 are drawn tightly for closing the open end 35 of pouch 14. In this position, pouch 14 may be positioned within a handbag or within a pouch of a dress or coat, for example, without soiling or contaminating the container or holder for pouch 14, because bib 10 including pouch 14 is formed of a waterproof material.

While drawstrings 42 and 44 and Velcro brand strips have been disclosed as providing a closure for the open end 35 of pouch 14, it is to be understood that other types of closures may be provided, such as other types of hook and loop strips, zippers, snaps or buttons, for example. Bib 10 may, if desired, be provided with sleeves and may be formed of various shapes as may be desired for children of different ages and sizes, for example.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A bib for fitting about the neck and over the chest of a child and arranged to be easily compressed and stored for transport; said bib comprising a body having a central body portion and a pair of neck portions extending from said central body portion, said body having an outer periphery and a marginal edge portion extending about said outer periphery; said central body portion having an inwardly facing rear surface for fitting against the chest of the child and an opposed outwardly facing front surface;

securing means for said neck portions-for securing said neck portions about the neck of the child to secure the bib thereon;

a pouch having a closed end and an open end and positioned adjacent said rear surface of said central body portion, said pouch secured at its closed end to said marginal edge portion at a position on said central body portion between said neck portions, said pouch extending in a free unsecured relation downwardly from said closed end on said marginal portion to said open end along said rear surface of the body portion;

said pouch being turned inside out and outside in when the bib is placed about the neck of a child with said pouch extending downwardly from said closed end secured to said marginal edge portion between said neck portions, said bib being stored in a compressed relation within said pouch via said closed end of said pouch while turning the outside of the pouch out about the compressed bib;

and a separate edge strip extends along said marginal edge portion on said outer periphery of said bib, said edge strip and said closed end of said pouch being secured together to said rear surface of said body portion between said neck portions.

2. A bib as set forth in claim 1 wherein:

said bib comprises a one piece fabric material defining said body.

* * * * *